United States Patent [19]

Stringer et al.

[11] Patent Number: 5,075,831

[45] Date of Patent: Dec. 24, 1991

[54] LIGHTING FIXTURE ASSEMBLY

[75] Inventors: Ralph S. Stringer, Gardena; Ronald A. Baker, Rancho Palos Verdes, both of Calif.

[73] Assignee: Hubbell Incorporated, Orange, Conn.

[21] Appl. No.: 651,999

[22] Filed: Feb. 7, 1991

[51] Int. Cl.[5] ..... F21S 1/02

[52] U.S. Cl. ..... 362/365; 362/147; 362/148; 362/364; 29/401.1; 29/412; 29/509

[58] Field of Search ..... 362/147, 148, 364, 365, 362/408; 248/343, 57; 29/401.1, 412, 462, 510, 509, 511

[56] References Cited

U.S. PATENT DOCUMENTS

| | | | |
|---|---|---|---|
| 2,060,893 | 11/1936 | Polivka et al. | 29/412 |
| 2,518,936 | 8/1950 | Roberts | 362/366 |
| 3,099,404 | 7/1963 | Kaufman et al. | 362/366 |
| 3,361,904 | 1/1968 | Docimo | 362/365 |
| 3,381,123 | 4/1968 | Docimo | 362/366 |
| 3,590,241 | 6/1971 | Docimo et al. | 362/366 |
| 3,660,651 | 5/1972 | Miles, Jr. | 362/366 |
| 3,683,173 | 8/1972 | Guth, Jr. | 362/366 |
| 3,700,885 | 10/1972 | Bobrick | 362/366 |
| 3,801,815 | 4/1974 | Docimo | 362/366 |
| 4,408,262 | 10/1983 | Kusmer | 362/364 |
| 4,459,429 | 7/1984 | Docimo | 174/65 R |
| 4,520,436 | 5/1985 | McNair et al. | 362/366 |
| 4,729,080 | 3/1988 | Fremont | 362/366 |
| 4,733,339 | 3/1988 | Kelsall | 362/366 |
| 4,803,603 | 2/1989 | Carson | 362/366 |
| 4,809,468 | 3/1989 | Bareiss | 362/147 |
| 4,910,651 | 3/1990 | Montanez | 362/365 |
| 4,972,339 | 11/1990 | Gabrius | 362/365 |

*Primary Examiner*—Ira S. Lazarus
*Assistant Examiner*—Y. Quach
*Attorney, Agent, or Firm*—Jerry M. Presson; Alfred N. Goodman; David L. Tarnoff

[57] ABSTRACT

A lighting fixture assembly having a plaster plate, and a tubular lamp housing for installing a recessed light into a ceiling. The plaster plate has a blank portion removed to form a lamp housing receiving aperture. The tubular lamp housing has a tubular sidewall, an open bottom end aligned with the lamp housing aperture in the plaster plate and a closed top end, which is formed by the blank portion removed from the plaster plate to form the lamp housing receiving aperture. Preferably, the tubular lamp housing is substantially cylindrical with the sidewall tapering slightly inwardly and upwardly from its open bottom end to its closed top end.

20 Claims, 4 Drawing Sheets

LIGHTING FIXTURE ASSEMBLY

FIELD OF THE INVENTION

This invention relates generally to a lighting fixture assembly and its method of manufacture. More specifically, the invention relates to an improved method of manufacturing a recessed lighting fixture assembly having a plaster plate, or mounting frame, and a tubular lamp housing with its closed top end being formed from a blank portion stamped out of the plaster plate to form the lamp housing receiving aperture.

BACKGROUND OF THE INVENTION

Recessed lighting fixtures have become increasingly popular in today's homes and businesses. Currently, there are many manufacturers of recessed lighting fixtures, and numerous designs available for mounting recessed lighting fixtures in a ceiling. These recessed lighting fixtures vary in design and configuration depending upon the type of installation, i.e., in new construction, in existing ceilings, or in sloped ceilings.

In more recent years, most designs for recessed lighting fixtures have included a sheet metal "plaster plate", or mounting frame, having a lighting fixture receiving aperture, and a cylindrical lamp housing, or a "can" type housing, mounted to the plaster plate with its open bottom end aligned with the lighting fixture receiving aperture. Typically, the lighting fixture receiving aperture of these prior designs is formed by first punching out a blank portion of the plaster plate to form a hole having a smaller diameter than the diameter of the lamp housing, and then bending the edge of the aperture downwardly or upwardly to strengthen the plaster plate and to increase the size of the aperture for receiving and coupling the lamp housing therein. The diameter of the lamp housing is smaller than the finished lighting fixture receiving aperture for mounting the lamp housing therein, but larger than the blank portion punched out of the plaster plate. This requires the manufacturer to use a separate steel disc or cap for closing the top end of the lamp housing. Furthermore, this prior method of manufacturing lighting fixture assemblies results in the blank portion punched out of the plaster plate being wasted, i.e., thrown out.

The recessed lighting fixture industry is a very competitive and high volume industry resulting in a small profit margin on each lighting fixture Accordingly, even a small improvement which lowers the manufacturing cost of lighting fixtures by 40 or 50 cents per unit can result in a significant increase in the profit margin and a significant competitive advantage over competitor's lighting fixtures.

Examples of prior lighting fixtures are disclosed in U.S. Pat. Nos.: 2,518,936 to Roberts; 3,099,404 to Kaufman et al; 3,361,904 to Docimo; 3,381,123 to Docimo; 3,590,241 to Docimo et al; 3,660,651 to Miles, Jr.; 3,683,173 to Guth, Jr.; 3,700,885 to Bobrick; 3,801,815 to Docimo; 4,459,429 to Docimo; 4,520,436 to McNair et al; 4,729,080 to Fremont et al; 4,733,339 to Kelsall; and 4,803,603 to Carson, the disclosures of which are hereby incorporated herein by reference.

In view of the above, it is apparent that there exists a continuing need for lowering the manufacturing costs of lighting fixtures to stay competitive in a very competitive industry such as the lighting fixture industry. Accordingly, this invention addresses this need in the art, along with other needs which will become apparent to those skilled in the art once given this disclosure.

SUMMARY OF THE INVENTION

Accordingly, a primary object of the present invention is to provide a method of manufacturing a lighting fixture assembly having a plaster plate and a lamp housing which utilizes a blank portion of the plaster plate for closing the top end of the lamp housing.

Another object of the present invention is to provide a lighting fixture assembly which is less expensive to manufacture and reduces waste of materials.

A further object of the present invention is to provide a lighting fixture assembly which is relatively simple to manufacture and assembly.

The foregoing objects are basically attained by a method of manufacturing a lighting fixture assembly, comprising the steps of constructing a mounting frame having a substantially flat base portion out of a sheet material for supporting a lamp, removing a blank portion of the sheet material of the mounting frame to form an aperture therein, and constructing a tubular lamp housing adapted to be coupled to the mounting frame, and having a tubular sidewall, an open bottom end, and a closed top end, the closed top end being formed by the blank portion removed from the mounting frame to form the aperture therein.

The foregoing objects are also basically attained by a lighting fixture assembly for supporting a lamp, the combination comprising: a mounting frame with a blank portion removed therefrom to form an aperture in the mounting frame; and a tubular lamp housing releasably coupled to the mounting frame, and having a tubular sidewall, an open bottom end aligned with the aperture, and a closed top end, the closed top end being formed by the blank portion removed from the mounting frame.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form a part of this original disclosure.

DETAILED DESCRIPTION OF THE INVENTION

Figure 1:
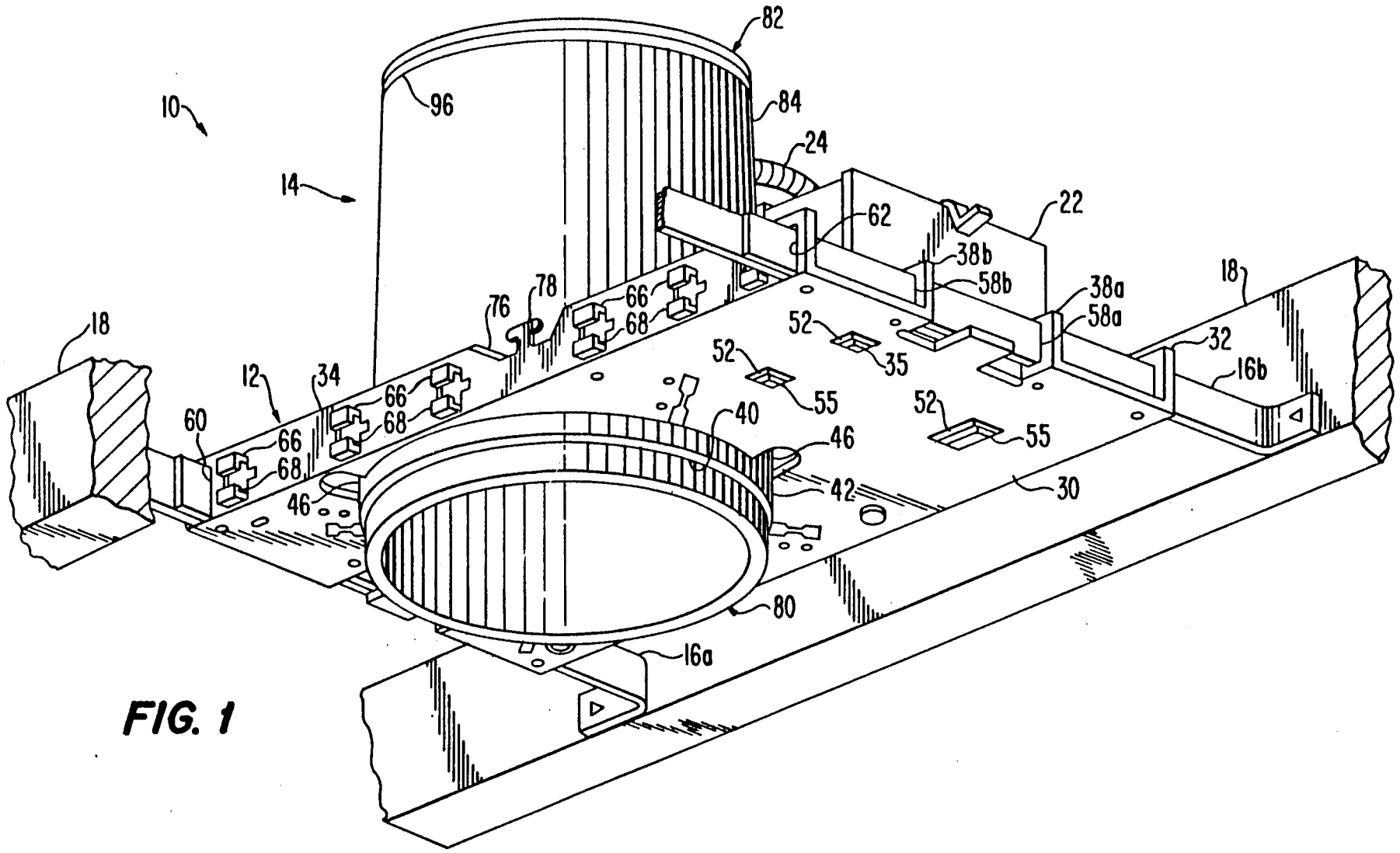
FIG. 1 is a left perspective view of a lighting fixture assembly in accordance with the present invention.
Figure 2:
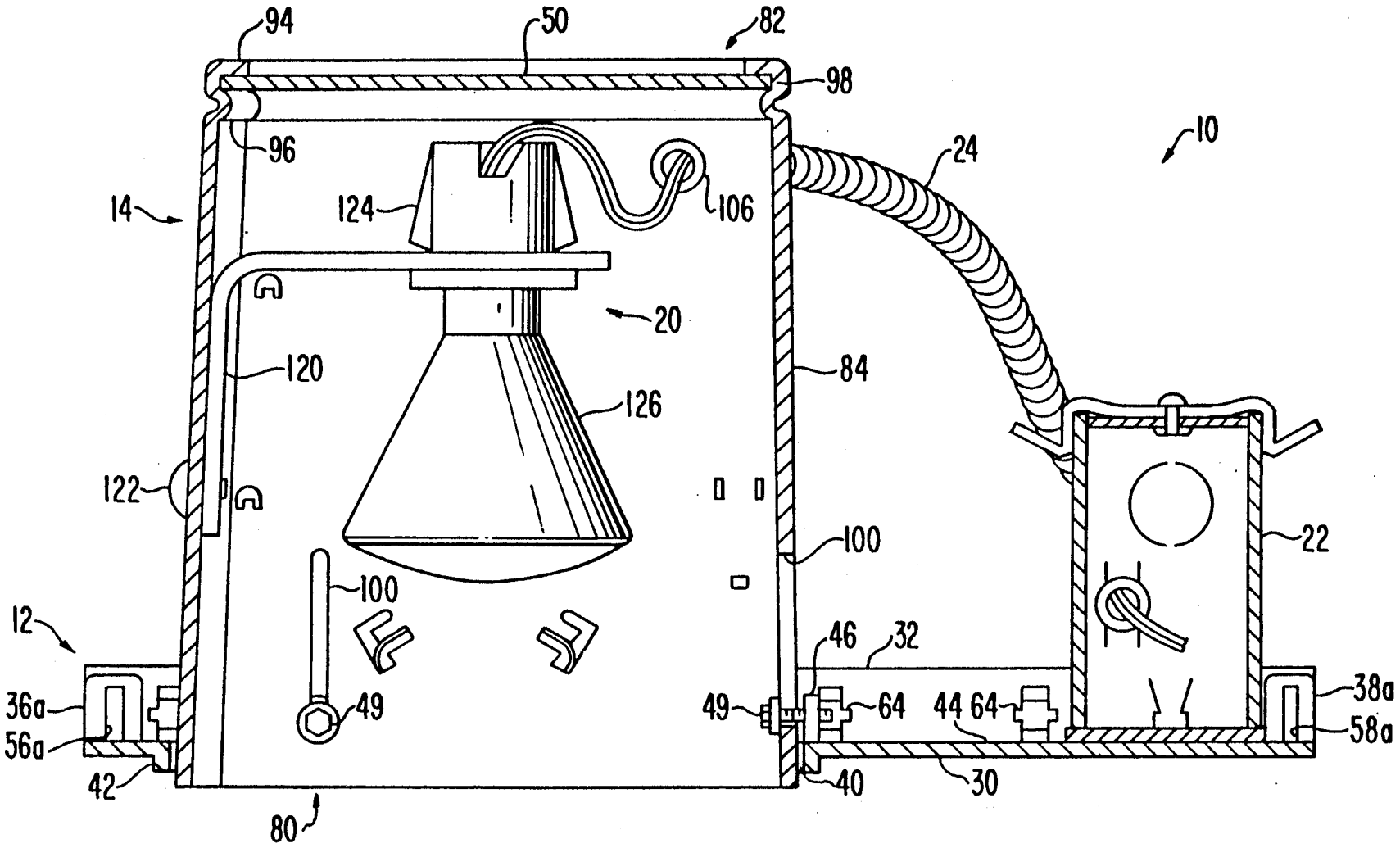
FIG. 2 is a side elevational view in longitudinal cross section of the lighting fixture assembly illustrated in FIG. 1.

Initially referring to FIGS. 1 and 2, a lighting fixture assembly 10 according to the present invention is illustrated, and includes a plaster plate or mounting frame 12, a tubular lamp housing or can 14 releasably coupled to plaster plate 12, a pair of adjustable bar hangers 16*a* and 16*b* for rigidly coupling plaster plate 12 between a pair of joists or support members 18, a lamp assembly 20 fixedly coupled to the interior of lamp housing 14, and a standard electrical junction box 22 rigidly coupled to plaster plate 12 and electrically coupled to lamp assembly 20 via electrical conduit 24.

Figure 3:
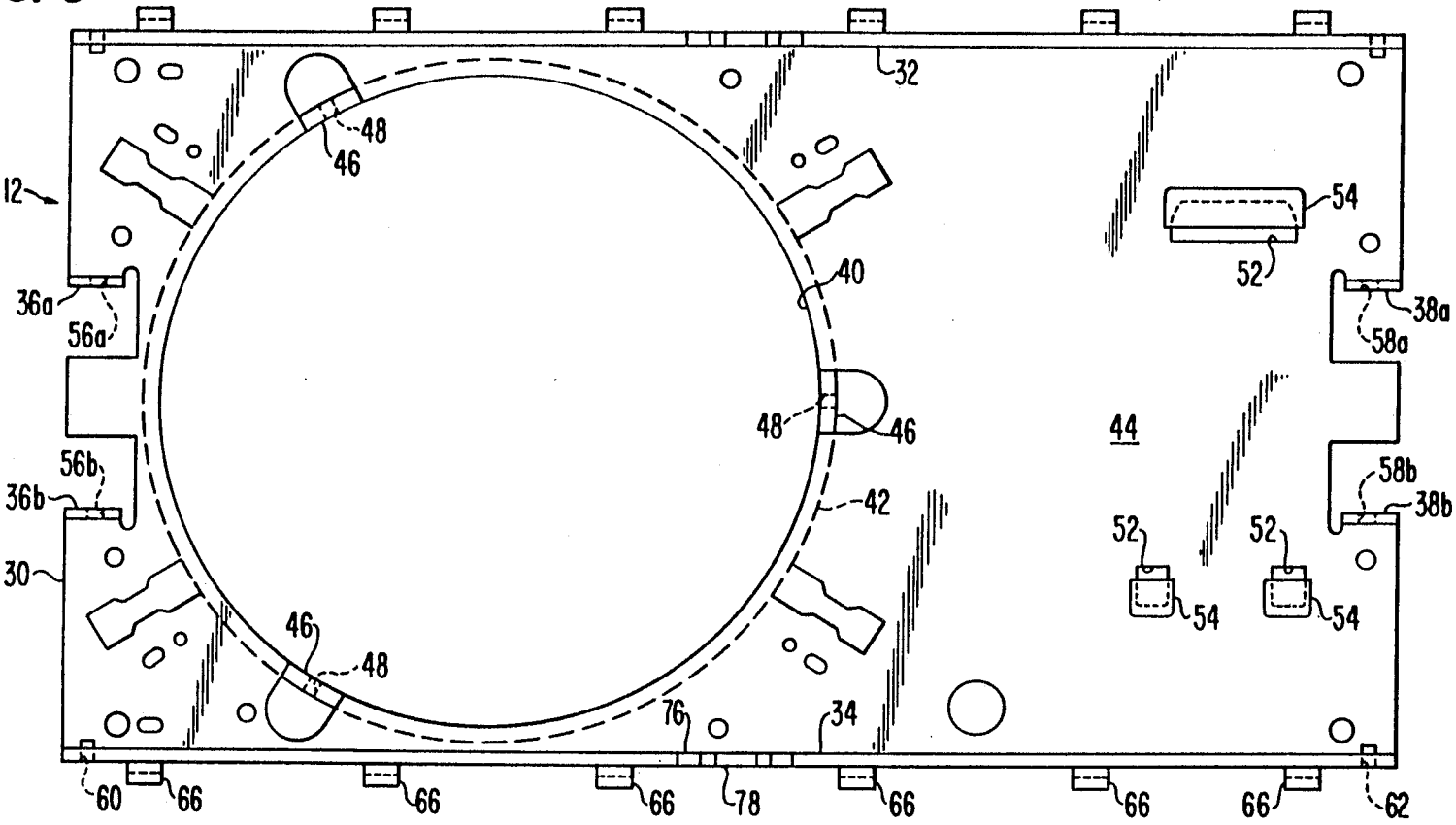
FIG. 3 is a top plan view of the plaster plate or mounting frame of the lightinq fixture assembly illustrated in FIGS. 1 and 2.
Figure 4:
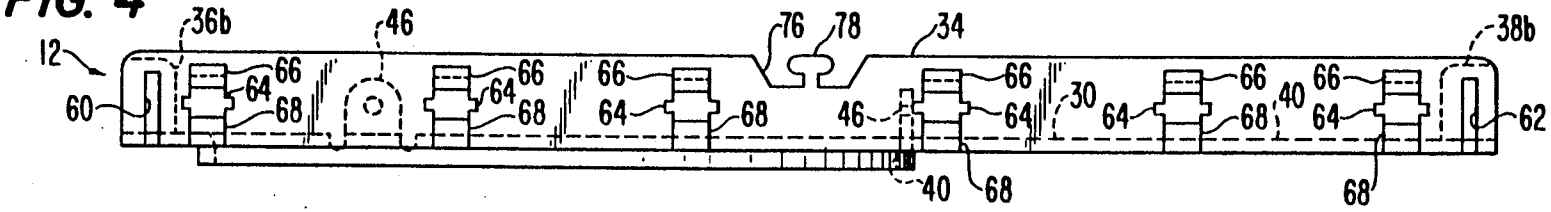
FIG. 4 is a side elevational view of the plaster plate illustrated in FIG. 3.
Figure 5:
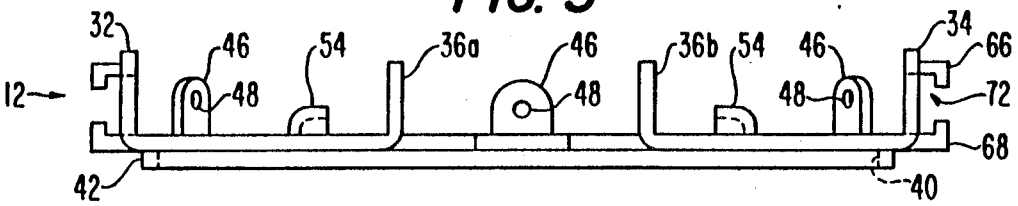
FIG. 5 is an end elevational view of the plaster plate illustrated in FIGS. 3 and 4.

Referring now to FIGS. 3-5, plaster plate 12 is a generally rectangular plate having a substantially flat, rectangular base portion 30, a pair of upwardly bent side rails 32 and 34 extending substantially perpendicular to base portion 30, and a first pair of end flanges 36*a* and 36*b* at one end of base portion 30 and a second pair of end flanges 38*a* and 38*b* at the opposite end of base portion 30. Preferably, plaster plate 12 is a one-piece, unitary, integral member formed by stamping a sheet material, such as 22 gauge steel sheet metal, into its desired shape as seen in FIGS. 3-5.

Base portion 30 has a lamp housing receiving aperture 40 with an annular, downwardly extending integral flange or collar 42 and a substantially flat platform area 44 for fixedly coupling junction box 22 thereon as seen in FIGS. 1 and 2.

Lamp housing receiving aperture 40 is preferably substantially circular and formed by stamping or punching out a substantially circular blank portion 50 from base portion 30 of plaster plate 12. The edge of base portion 30 surrounding lamp housing receiving aperture 40 is then bent or extruded downwardly to form an optional annular collar or flange 42.

Annular collar 42 provides additional strength to base portion 30 adjacent lamp housing receiving aperture 40 to adequately support lamp housing 14 with lamp assembly 20 coupled therein on plaster plate 12. As a result of bending the edge of base portion 30 surrounding lamp receiving aperture 40 to form annular collar 42, the diameter of lamp receiving aperture 40 is increased by twice the length of annular collar 42 extending downwardly from base portion 30. Before bending and forming the collar, the diameter of aperture 40 is substantially equal to the diameter of blank portion 50. Accordingly, the diameter of lamp housing receiving aperture 40, as seen in FIG. 2 having annular collar 42 formed thereon, is slightly larger than the diameter of blank portion 50, which was removed or punched out of base portion 30 of plaster plate 12, the additional diameter comprising twice the length of the annular collar 42. Blank portion 50 is used to close the top end of lamp housing 14 as seen in FIG. 2 and as discussed in more detail below.

As particularly seen in FIG. 5, base portion 30 also has three mounting tabs 46 bent approximately 90° upwardly adjacent lamp housing aperture 40. In particular, mounting tabs 46 are stamped out of base portion 30, and then bent upwardly. Preferably, mounting tabs 46 are spaced approximately 120° apart around the edge of lamp housing receiving aperture 40. Each of the mounting tabs 46 has a hole 48 for receiving a sheet metal screw 49, or any other suitable fastener, to releasably couple lamp housing 14 to plaster plate 12 as seen in FIG. 2.

Base portion 30 has three slots 52 extending through platform area 44 with a portion of each slot 52 being covered by a raised portion 54. Each slot 52 receives a bendable tang 55 extending from the bottom of junction box 22 for fixedly coupling junction box 22 to platform area 44 of base portion 30. In particular, each tang 55 is inserted through one of slots 52, and then bent beneath raised portion 54 for fixedly coupling junction box 22 to plaster plate 12. This arrangement is described in more detail in U.S. Pat. No. 4,459,429 to Docimo, the disclosure of which is hereby incorporated herein by reference.

Each of the end flanges 36*a* and 36*b* has a vertical slot 56*a* and 56*b*, respectively, for receiving bar hanger 16*a* therethrough, while each of the end flanges 38*a* and 38*b* has a vertical slot 58*a* and 58*b* for receiving bar hanger 16*b* therethrough.

Side rails 32 and 34 are substantially identical, except that they face in opposite directions Accordingly only side rail 34 will be discussed in detail.

As seen in FIGS. 4 and 5, side rail 34 has a pair of vertically extending end slots 60 and 62 adjacent the opposite ends of side rail 34. Slot 60 is horizontally aligned with a corresponding slot in side rail 32 and with slots 56*a* and 56*b* of end flanges 36*a* and 36*b* to receive bar hangers 16*a* therethrough. Slot 62 is horizontally aligned with a corresponding slot in side rail 32 and with slots 58*a* and 58*b* of end flanges 38*a* and 38*b* to receive bar hanger 16*b* therethrough.

Side rail 34 also includes a plurality of equally spaced apart openings 64 with a pair of vertically spaced L-shaped flanges 66 and 68 adjacent each of the openings 64. Flanges 66 face flanges 68 to form a horizontal slot 72 for receiving bar hanger 16*a* or 16*b* therein. In particular, flanges 66 are substantially horizontally aligned with each other at the top of openings 64, while flanges 68 are horizontally aligned with each other at the bottom of openings 64 for supporting a bar hanger in a substantially horizontal position.

Accordingly, plaster plate 12 can be fixedly coupled to joists 18 by bar hangers 16*a* and 16*b* so that side rails 32 and 34 of plaster plate 12 extend either parallel or perpendicular to joists 18 depending upon which slots bar hangers 16*a* and 16*b* are positioned in.

The top free end of side rail 34 has a notch 76 therein with a T-shaped tab 78 extending vertically upwardly from the center of notch 76. Tab 78 is adapted to be bent outwardly and downwardly upon bar hanger 16*a* or 16*b* supported in slot 72 by flanges 66 and 68 for locking bar hanger 16*a* or 16*b* at its desired length.

As seen in FIG. 1, the adjustable bar hangers 16*a* and 16*b* comprise a pair of slidably connected strips with spikes on the outer ends which are driven into joists 18 to couple plaster plate 12 thereto. Since bar hangers, such as bar hangers 16*a* and 16*b* are conventional, they will not be discussed or illustrated in detail herein.

Figure 6:
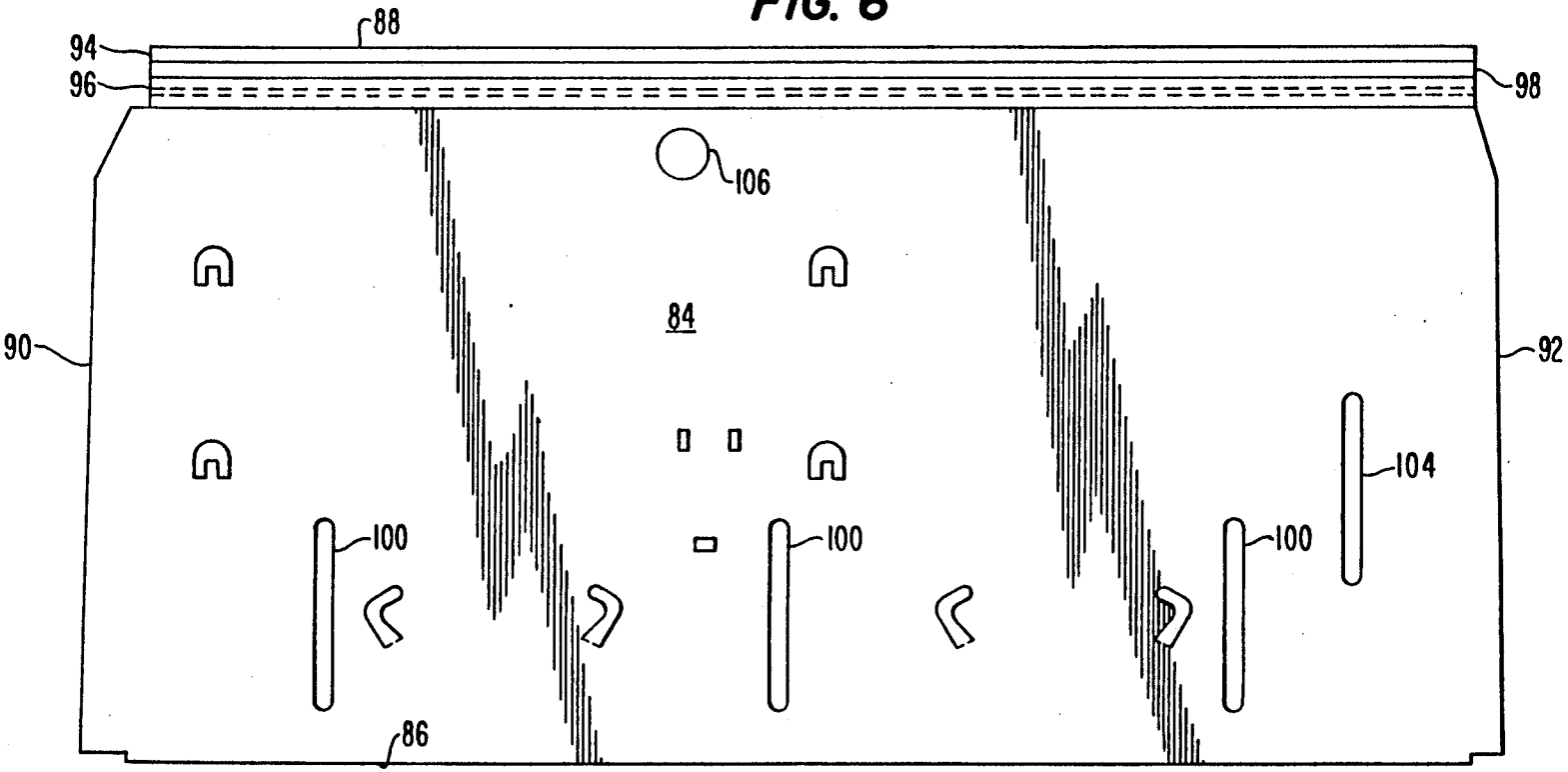
FIG. 6 is a side elevational view of the sidewall of the lamp housing of the lighting fixture assembly illustrated in FIGS. 1 and 2, prior to assembly.

As particularly seen in FIG. 2, lamp housing 14 is substantially cylindrical with an open bottom end 80, a closed top end 82 and a substantially cylindrical sidewall 84. Preferably, lamp housing 14 is formed by first stamping a sheet material, such as 22 gauge steel sheet metal, into the desired configuration as seen in FIG. 6, and then wrapping sidewall 84 about blank portion 50 to form a "can" or tube with a closed upper end as seen in FIG. 1. In particular, sidewall 84 is initially stamped to form a substantially flat rectangular plate having a lower edge 86, an upper edge 88 extending substantially parallel to lower edge 86 and a pair of side edges 90 and 92 sloping upwardly and inwardly approximately 1° towards each other.

Preferably, sidewall 84 of lamp housing 14 tapers inwardly and upwardly from open bottom end 80 to closed top end 82 to form a substantially frustoconical tube. This allows lamp housing 14 to be easily inserted and removed from lamp housing aperture 40 since the closed top end 82 is smaller than the open bottom end 80, and thus provides additional clearance between lamp housing 14 and plaster plate 12.

During stamping, upper edge 88 is bent about 90° to form a flange 94 extending substantially perpendicular to the sidewall 84, and indented or crimped to form a longitudinal indentation 96 extending substantially parallel to flange 94. Indentation 96 is spaced downwardly from flange 94 to form a recess or groove 98 between flange 94 and indentation 96 for receiving blank portion 50 therein. When sidewall 84 is wrapped about blank portion 50, flange 94 and the protruding side of indentation 96 will both extend radially inwardly toward the center of lamp housing 14. It should be apparent that flange 94 and indentation 96 can be either continuous or discontinuous as necessary for coupling blank portion 50 to sidewall 84. For example, a discontinuous flange and a plurality of circular indentations can be used for coupling blank portion 50 to lamp housing 14. Also, blank portion 50 can be coupled to sidewall 84 in any other suitable manner, such as by welding.

In forming lamp housing 14, blank portion 50 is placed in recess 98, and sidewall 84 is then wrapped about blank portion 50 to form a substantially cylindrical or frustoconical tube. Then, the side edges 90 and 92 are fixedly coupled together by bending the side edges 90 and 92 together in a conventional manner such as to form a conventional seam known in the industry as an ACME LOCK.

The sidewall 84 also has three vertically extending mounting slots 100 for releasably coupling lamp housing 14 to plaster plate 12 by suitable fasteners, such as sheet metal screws 49, as seen in FIG. 2. Mounting slots 100 are spaced a 120° apart when sidewall 84 is formed or wrapped into a substantially cylindrical tube. Accordingly, slots 100 will align with holes 48 of mounting tabs 46 for securing lamp housing 14 to plaster plate 12 via screws 49. Mounting slots 100 also permit vertical adjustment of lamp housing 14 relative to plaster plate 12 as seen in FIG. 2.

A vertical coupling slot 104 is also formed in sidewall 84 by stamping for fixedly coupling lamp assembly 20 thereto as discussed below. A hole 106 is stamped through sidewall 84 for providing access for the electrical wires of electrical conduit 24 to be electrically coupled to lamp assembly 20.

Also, the sidewall 84 may be provided with various other apertures, tabs, or flanges for mounting trim plates, a thermal protector and other conventional devices in a conventional manner.

Lamp assembly 20 includes a lamp socket bracket 120 fixedly coupled to sidewall 84 via a suitable fastener such as rivet 122, a lamp socket 124 rigidly coupled to lamp socket bracket 120 for supporting a lamp 126 in the center of lamp housing 14. Lamp socket 124 is electrically coupled to junction box 22 via electrical conduit 24. Since lamp assemblies, such as lamp assembly 20, are well known in the art, lamp assembly 20 will not be discussed in detail herein.

While only one embodiment has been chosen to illustrate the invention, it will be understood by those skilled in the art that various changes and modifications can be made herein without departing from the scope of the invention as defined in the appended claims.

What is claimed is:

1. A method of manufacturing a lighting fixture assembly, comprising the steps of constructing a mounting frame having a substantially flat base portion out of a sheet material for supporting a lamp, removing a blank portion of the sheet material of the mounting frame to form an aperture therein, and constructing a tubular lamp housing adapted to be coupled to the mounting frame, and having a tubular sidewall, an open bottom end, and a closed top end, the closed top end being formed by the blank portion removed from the mounting frame to form the aperture therein.

2. A method of manufacturing a lighting fixture assembly according to claim 1, wherein the step of removing a blank portion of the sheet material of the mounting frame includes the step of stamping the mounting frame to remove the blank portion forming the aperture.

3. A method of manufacturing a lighting fixture assembly according to claim 2, wherein the aperture being stamped is substantially circular.

4. A method of manufacturing a lighting fixture assembly according to claim 1, and further comprising the step of bending an edge of the mounting frame adjacent the aperture to form an annular flange extending substantially perpendicular to the base portion.

5. A method of manufacturing a lighting fixture assembly according to claim 1, wherein the sheet material being used to construct the mounting frame is sheet metal.

6. A method of manufacturing a lighting fixture assembly according to claim 1, wherein the step of constructing the tubular lamp housing includes the steps of stamping the sidewall of the tubular lamp housing out of a substantially flat sheet material to form a substantially rectangular sheet with an upper edge, a lower edge and a pair of side edges, and then wrapping the substantially rectangular sheet to form the tubular sidewall.

7. A method of manufacturing a lighting fixture assembly according to claim 6, wherein the step of stamping the sidewall of the tubular lamp housing includes the steps of bending the upper edge of the sidewall about 90° to form an inwardly extending flange, and indenting a portion of the sidewall adjacent the flange to form a recess between the flange and the indented portion of the sidewall for receiving the blank portion removed from the mounting frame therein.

8. A method of manufacturing a lighting fixture assembly according to claim 7, wherein the indented portion is an elongated indentation extending substantially parallel to the flange.

9. A method of manufacturing a lighting fixture assembly according to claim 8, wherein the sidewall of the tubular lamp housing is made of sheet metal.

10. A method of manufacturing a lighting fixture assembly according to claim 6, wherein the tubular sidewall is wrapped to form a frustoconical tube with the top end being smaller in diameter than the bottom end.

11. A lighting fixture assembly for supporting a lamp, the combination comprising:

a mounting frame with a blank portion removed therefrom to form an aperture in said mounting frame; and a tubular lamp housing releasably coupled to said mounting frame, and having a tubular sidewall, an open bottom end aligned with said aperture, and a closed top end, said closed top end being formed by said blank portion removed from said mounting frame.

12. A lighting fixture assembly according to claim 11, wherein said blank portion is substantially circular.

13. A lighting fixture assembly according to claim 12, wherein said sidewall of said tubular lamp housing is substantially cylindrical.

14. A lighting fixture assembly according to claim 13, wherein said sidewall of said tubular lamp housing tapers slightly inwardly and upwardly from said open bottom end to said closed top end.

15. A lighting fixture assembly according to claim 14, wherein said sidewall of said lamp housing is made of sheet metal.

16. A lighting fixture assembly according to claim 11, wherein said mounting frame includes a substantially flat, rectangular base portion with said aperture extending therethrough.

17. A lighting fixture assembly according to claim 16, wherein said base portion has an annular flange extending downwardly around said aperture.

18. A lighting fixture assembly according to claim 16, wherein said base portion has a plurality of mounting tabs extending upwardly therefrom and adjacent said aperture.

19. A lighting fixture assembly according to claim 18, wherein said base portion further includes a pair of parallel side rails extending upward therefrom for receiving bar hangers to couple said mounting frame between a pair of support members.

20. A lighting fixture assembly according to claim 11, wherein said aperture has a substantially circular configuration, said base portion has an annular flange extending downwardly around said aperture, said blank portion having a substantially circular outer periphery having a diameter substantially equal to the diameter of said aperture minus twice the length of said annular flange.

* * * * *